US007559960B2

(12) United States Patent
Sato

(10) Patent No.: US 7,559,960 B2
(45) Date of Patent: Jul. 14, 2009

(54) MANUFACTURING METHOD OF WATER EMULSION FUEL

(75) Inventor: Hiroyasu Sato, Oyama (JP)

(73) Assignee: Komatsu Ltd., Tokyo (JP)

( * ) Notice: Subject to any disclaimer, the term of this patent is extended or adjusted under 35 U.S.C. 154(b) by 392 days.

(21) Appl. No.: 10/615,801

(22) Filed: Jul. 10, 2003

(65) Prior Publication Data

US 2004/0025416 A1 Feb. 12, 2004

(30) Foreign Application Priority Data

Aug. 8, 2002 (JP) ..... 2002-230820

(51) Int. Cl.
*C10L 1/32* (2006.01)

(52) U.S. Cl. ..... 44/301; 44/302

(58) Field of Classification Search ..... 44/301, 44/302; 516/9

See application file for complete search history.

(56) References Cited

U.S. PATENT DOCUMENTS 3,606,868 A * 9/1971 Voogd ..... 123/25 R
5,584,894 A * 12/1996 Peter-Hoblyn et al. ..... 44/301
5,873,916 A * 2/1999 Cemenska et al. ..... 44/301
6,302,929 B1 * 10/2001 Gunnerman ..... 44/302
6,652,607 B2 * 11/2003 Langer et al. ..... 44/301

FOREIGN PATENT DOCUMENTS

JP 2000-263062 A 9/2000
JP 2002-294260 A 10/2002

* cited by examiner

*Primary Examiner*—Cephia D Toomer
(74) *Attorney, Agent, or Firm*—Posz Law Group, PLC

(57) ABSTRACT

A manufacturing method of a water emulsion fuel by which the O/W type water emulsion fuel can be reliably manufactured. For this purpose, an initial method of the manufacturing method has a fuel and additive charging step, an agitating step of agitating the fuel and the additive, a water charging step of charging a predetermined amount of water into a mixing tank, a fine processing step of pumping out a mixture solution of the fuel and the additive, and the water to pass them through the fine processing means and returning them into the mixing tank, a separating step of separating the water and the fuel, and an emulsifying step of emulsifying the fuel, the additive and the water by the step of pumping out the charged solution from the mixing tank, passing it through the fine processing means and returning it to the mixing tank.

6 Claims, 3 Drawing Sheets

MANUFACTURING METHOD OF WATER EMULSION FUEL

TECHNICAL FIELD

The present invention relates to a manufacturing method of an emulsion fuel for a diesel engine, which is a mixture of water and a fuel, particularly, an O/W type (water is a continuous phase) water emulsion fuel.

BACKGROUND ART

As a fuel for a diesel engine to reduce occurrence of injurious materials such as smoke particulates in an exhaust gas, and nitrogen oxides, an emulsion fuel with water and a fuel being mixed conventionally exists. As an example of an art of manufacturing the emulsion fuel, the one disclosed in Japanese Patent Laid-open No. 2000-263062 is cited.

FIG. 6 is an explanatory view of a manufacturing apparatus of reformed water disclosed in the aforesaid Japanese Patent Laid-open No. 2000-263062. A water tank 101A is provided with a water supply circuit 123 for supplying water. A circulation circuit 114 for returning a solution from the water tank 101A to the water tank 101A again is provided. A circulation circuit on-off valve 115, a circulating pump 111A, and a fine eddy-current generating device 140 and a magnetic field applying device 141 are placed in series in order. Between the circulation circuit on-off valve 115 and the circulation pump 111A of the circulation circuit 114, a supplementary agent adding device 142 is connected by a circuit 143, and a circuit on-off valve 144 is provided on the circuit 143. A water storage tank 104A for storing the reformed water is connected to the water tank 101A by a solution delivery circuit 110. A solution delivery circuit on-off valve 113 and a solution delivery pump 118 are provided in series in order on the solution delivery circuit 110. The water storage tank 104A is provided with a discharge circuit 116 having a discharge circuit on-off valve 117.

An operation will be explained. First, water is supplied to the water tank 101A from the water supply circuit 123. Next, the circulation circuit on-off valve 115 is opened and the circulation pump 111A is operated. At the same time, the circuit on-off valve 144 is opened for a predetermined period of time to add a surface active agent being a predetermined amount of additive to the circulation circuit 114 from the supplementary agent adding device 142. Thereupon, the solution of water and the surface active agent is reformed via the fine eddy-current generating device 140 and the magnetic field applying device 141, and returned to the water tank 101A. By repeating this, the solution in the water tank 101A is completely reformed, and a reformed water of good quality is obtained. After this process is finished, the circulation circuit on-off valve 115 is closed, and the circulation pump 111A is stopped. Next, the solution delivery circuit on-off valve 113 is opened, then the solution delivery pump 118 is operated, the reformed solution is sent to the storage tank 104A, and the discharge circuit on-off valve 117 is opened to supply the reformed solution to an outside. According to the above, the emulsion fuel is obtained by supplying water and a petroleum fuel into the water tank 101A.

However, in the above-described constitution, water inside the water tank 101A is only pumped out with the circulating pump 111A and circulated, and therefore the reformed water or the emulsion fuel inside the water tank 101A are not distributed uniformly, thus causing a fear that the partially insufficient reformed one exists. Accordingly, there arises a fear that the partially insufficient reformed one is supplied into the storage tank 104A and the reformed water or emulsion fuel of inferior quality mixes in the product.

SUMMARY OF THE INVENTION

Consequently, the person in charge of development of the assignee of the present application made the research to develop the highly efficient emulsion manufacturing method without a fear of the emulsion fuel of inferior quality mixing therein. On starting the research, it was taken into consideration that an O/W type emulsion fuel is safer, though there are the O/W type (water is the continuous phase) and a W/O type (fuel is the continuous phase) of emulsion fuels. The result of this research was filed as Japanese Patent Application No. 2001-094264 under the name of the assignee of the present application. Japanese Patent Application No. 2001-094264 had not been made public when the priority claiming basic application (Japanese Patent Application No. 2002-230820) of the present application was filed, but at the time of the U.S. patent application, which is the present application, the Official Gazette has been issued as Japanese Patent Laid-open No. 2002-294260.

FIG. 4 is a block diagram of an emulsion fuel manufacturing apparatus 1 disclosed in Japanese Patent Application No. 2001-094264. In FIG. 4, a mixing tank 2 is provided with an agitating device 3 and a drain valve 7. The drain valve 7 is provided at a part under an oil storage tank 4. The mixing tank 2 and the oil storage tank 4 are connected by a solution delivery circuit 10. On the solution delivery circuit 10, a mixture solution pump 11, fine processing means 12, and a solution delivery circuit on-off valve 13 are provided in series in order from the side of the mixing tank 2.

The solution delivery circuit 10 and the mixing tank 2 are connected by a circulation circuit 14 between the fine processing means 12 and a solution delivery circuit on-off valve 13, and a circulation circuit on-off valve 15 is provided on the circulation circuit 14. The oil storage tank 4 is provided with a discharge circuit 16 having a discharge circuit on-off valve 17. A fuel supply circuit 21 for supplying a petroleum fuel to the mixing tank 2 is provided with a fuel circuit on-off valve 22, a water supply circuit 23 for supplying water is provided with a water circuit on-off valve 24, and an additive supply circuit 25 is provided with an additive metering pump 26, respectively. The mixing tank 2 is provided with an overflow liquid level switch 30, a water level switch 31, a fuel level switch 32, and a low-level liquid level switch 33 in order from the top. The oil storage tank 4 is provided with the overflow liquid level switch 30, a fuel addition level switch 34, and the low-level liquid level switch 33 in order from the top.

A controller 35 inputs detection signals from the over flow liquid level switch 30, the water level switch 31, the fuel level switch 32 and the low-level switch 33, which are provided at the mixing tank 2. The controller 35 outputs control signals to the fuel circuit on-off valve 22, the water circuit on-off valve 24, and the additive metering pump 26. The controller 35 constitutes supply control means 20 by them, and outputs a control signal to the agitating device 3. Further, the controller 35 inputs detection signals therein from the overflow liquid level switch 30, the fuel addition level switch 34, and the low-level liquid level switch 33, which are provided at the oil storage tank 4, and outputs control signals to the mixture solution pump 11, the liquid delivery circuit on-off valve 13, the circulation circuit on-off valve 15 and a warning device 36.

In FIG. 5, one or a plurality of minute-holes perforated plate 41 or plates 41 having a number of minute holes 42 (about 0.5 mm to 1 mm in diameter) is or are included in a casing 40. Liquid passes through the minute-holes perforated plate 41 in the arrow direction, whereby it is released as turbulent jet having a minute-eddy structure. In this situation, a huge cluster of a liquid molecule is finely crushed into small clusters by a turbulent action. Other than this structure, there are the structure in which a fixed blade having torsion is placed inside the casing 40, the structure which vibrates liquid with use of ultrasound, and the like. By passing the fuel including the additive and water through the fine processing means 12, the huge graft of the fuel and water is made minute grafts, and the fuel and the water can be emulsified.

A manufacturing process of the emulsion fuel will be explained. The controller 35 outputs the control signal to close the liquid delivery circuit on-off valve 13 and open the circulation circuit on-off valve 15. Next, the controller 35 outputs the control signal to the fuel circuit on-off valve 22 to open it, supplies the petroleum fuel into the mixing tank 2 from the fuel supply circuit 21 until the fuel level switch 32 is turned ON, and closes the fuel circuit on-off valve 22. Next, the controller 35 outputs the control signal to the water circuit on-off valve 24 to open it, supplies water and the petroleum fuel until the water level switch 31 is turned ON, and closes the water circuit on-off valve 24. At the same time, the controller 35 outputs the control signal to the additive metering pump 26 to add a predetermined amount of additive into the mixing tank 2 from the additive supply circuit 25. At the same time, the controller 35 operates the agitating device 2 to agitate the mixture solution.

Next, the controller 35 drives the mixture solution pump 11. Then, the mixture solution passes through the fine processing means 12, and returns to the mixing tank 2 via the circulation circuit on-off valve 15, and the circulation circuit 14. By repeating this operation for a predetermined period of time, the fuel and the water are emulsified, and an emulsion fuel is manufactured. When the circulating time reaches the predetermined period of time, the controller 35 closes the circulation circuit on-off valve 15, and opens the solution delivery circuit on-off valve 13. The emulsion fuel passes through the fine processing means 12 and delivered into the oil storage tank 4 via the solution delivery circuit 10 by the mixture solution pump 11. The emulsion fuel stored inside the oil storage tank 4 is supplied to an outside by opening the discharge circuit on-off valve 17 as necessary.

When the emulsion fuel inside the mixing tank 2 decreases, and the low-level liquid level switch 33 is turned ON, the controller 35 closes the solution delivery circuit on-off valve 13, opens the circulation circuit on-off valve 15 to return to the initial step, and manufactures the emulsion fuel. Namely, the manufacturing process is a batch type. Accordingly, at the time of initial manufacture, the mixing tank 2 is vacant, and from the second time on, the emulsion fuel up to the low-level liquid level switch 33 remains in the mixing tank 2 at the time of starting the manufacture. This is for preventing the mixture solution pump 11 from sucking air.

However, the present inventor grasps that there are the following problems in the above-described method as a result of the experiment.

A fuel is initially charged into the mixing tank 2, then water and an additive are charged into it, and they are agitated. The additive has the property easy to combine with water but difficult to combine with the fuel. Consequently, there is the problem that when the fuel, water, and the additive are charged and agitated, the water combines with the additive but does not combine with the fuel, and is not favorably emulsified.

At the initial time of the batch type manufacturing process, the fuel is initially put into the mixing tank 2 with substantially no emulsion fuel, and most of what is pumped out and delivered to the fine processing means 12 with the mixture solution pump 11 is only the fuel at first. When the fuel is finely processed initially with the fine processing means 12, an oil rich state is established, and therefore there arises the problem that the O/W type water emulsion fuel cannot be obtained.

The present invention is made in view of the above-described problems, and has its object to provide a manufacturing method of a water emulsion fuel with which an O/W type water emulsion fuel can be reliably manufactured.

In order to attain the above-described object, a first aspect of the manufacturing method of the water emulsion fuel according to the present invention is: an initial manufacturing method of a batch type manufacturing method of a water emulsion fuel for manufacturing the water emulsion fuel from a state in which substantially no water emulsion fuel exists in a mixing tank of an emulsion fuel manufacturing apparatus including the mixing tank for mixing a fuel, water and an additive, an agitating device provided inside the mixing tank, and fine processing means for finely processing a mixture solution of the fuel, the water and the additive to emulsify it; and has (a) a fuel and additive charging step of charging a predetermined amount of the fuel and the additive into the mixing tank; (b) an agitating step of agitating the fuel and the additive charged into the mixing tank by the agitating device; (c) a water charging step of charging a predetermined amount of water into the mixing tank after finishing the agitating step; (d) a fine processing step of pumping out a mixture solution of the fuel and the additive, and the water in the mixing tank to pass them through the fine processing means and returning them into the mixing tank; (e) a separating step of separating the water and the fuel after finishing the fine processing step; and (f) an emulsifying step of emulsifying the fuel, the additive and the water by the step of pumping out the charged solution from the mixing tank, passing it through the fine processing means and returning it to the mixing tank, after finishing the separating step.

According to the above method, when the water emulsion fuel is manufactured in the state in which substantially no water emulsion fuel exists in the mixing tank, the agitating step of charging the predetermined amount of fuel and additive into the mixing tank and agitating them is provided first. As a result, the additive is favorably dispersed into the fuel, and emulsification with water is made easy. Next, water is charged and passed through the fine processing means, whereby the charged solution is finely processed. This step establishes the state in which the fuel and water are easily emulsified in the following emulsifying step. Further, the separating step of separating the water and the fuel is provided, and thereafter emulsification is performed, whereby the water is finely processed first and returned to the mixing tank, and then the fuel with the additive being favorably dispersed is finely processed and returned to the mixing tank. As a result, the water rich state is established, and by repeating this process, finely clustered water molecules are bonded around the fuel including the additive, thus making it possible to obtain the O/W type water emulsion fuel of good quality.

In the manufacturing method of the water emulsion fuel: the agitating step may be provided in parallel with at least either the fine processing step or the emulsifying step. According to this method, since agitation is performed in the mixing tank in the fine processing step and/or the emulsifying step, the fuel, the additive, and the water are mixed more uniformly, and emulsification of the fuel and water is further promoted.

A second aspect of the manufacturing method of the water emulsion fuel is: a manufacturing method of a water emulsion fuel being a manufacturing method from a second time on of a batch type manufacturing method of a water emulsion fuel for manufacturing the water emulsion fuel from a state in which a predetermined amount of water emulsion fuel exists in a mixing tank of an emulsion fuel manufacturing apparatus including the mixing tank for mixing a fuel, water and an additive, an agitating device provided inside the mixing tank, and fine processing means for finely processing a mixture solution of the fuel, the water and the additive to emulsify it; and has (a) a fuel and additive charging step of charging a predetermined amount of the fuel and the additive into the mixing tank; (b) an agitating step of agitating the water emulsion fuel in the mixing tank and the charged fuel and additive by the agitating device; (c) a water charging step of charging a predetermined amount of water into the mixing tank after finishing the agitating step; and (d) an emulsifying step of emulsifying the fuel, the additive and the water by the step of pumping out the charged solution from the mixing tank, passing it through the fine processing means and returning it to the mixing tank.

According to the above method, when the water emulsion fuel is manufactured in the state in which the predetermined water emulsion fuel exists in the mixing tank, the agitating step of charging the predetermined amount of fuel and additive into the mixing tank and agitating them is provided first. As a result, the additive is favorably dispersed into the fuel, and emulsification with the water is made easy. Next, water is charged, and the charged solution is pumped out from the mixing tank and passed through the emulsifying means. In this case, the water emulsion fuel is passed through the fine processing means first, the water emulsion fuel is returned to the mixing tank, then the fuel with the additive being favorably dispersed is finely processed and returned into the mixing tank, and further, the water is finely processed and returned to the mixing tank. As a result, the water rich state is established, and by repeating this process, the finely clustered water molecules are bonded around the fuel including the additive, and the O/W type water emulsion fuel of good quality is obtained. This process has the smaller number of steps and is more efficient as compared with the case of manufacturing the water emulsion fuel in the state in which substantially no water emulsion fuel exists in the mixing tank.

BEST MODE FOR CARRYING OUT THE INVENTION

Embodiments of a manufacturing method of a water emulsion fuel according to the present invention will be explained in detail below with reference to the drawings.

Figure 1:
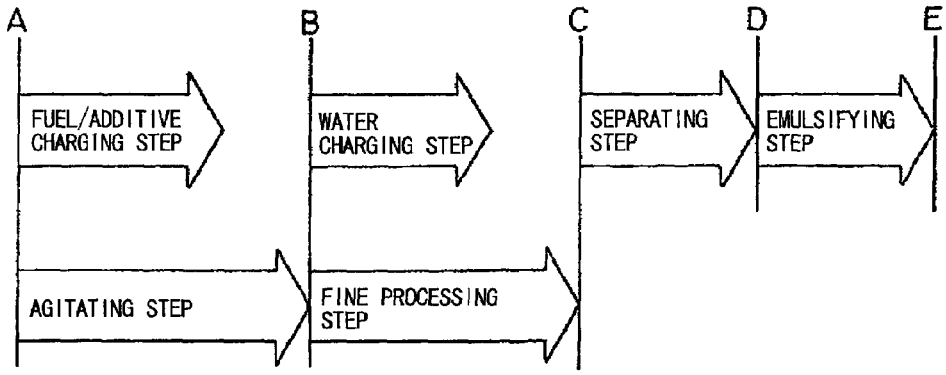
FIG. 1 is a flow chart of manufacture of a water emulsion fuel according to a first embodiment of the present invention.
Figure 4:
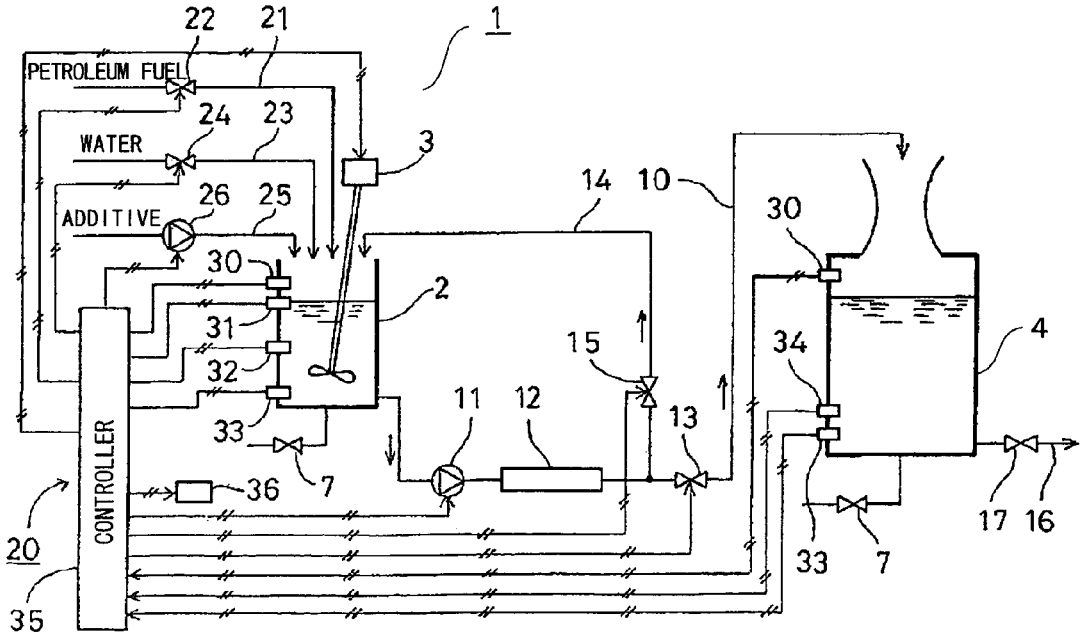
FIG. 4 is a block diagram of an emulsion fuel manufacturing apparatus in a process to the present invention.
Figure 5:
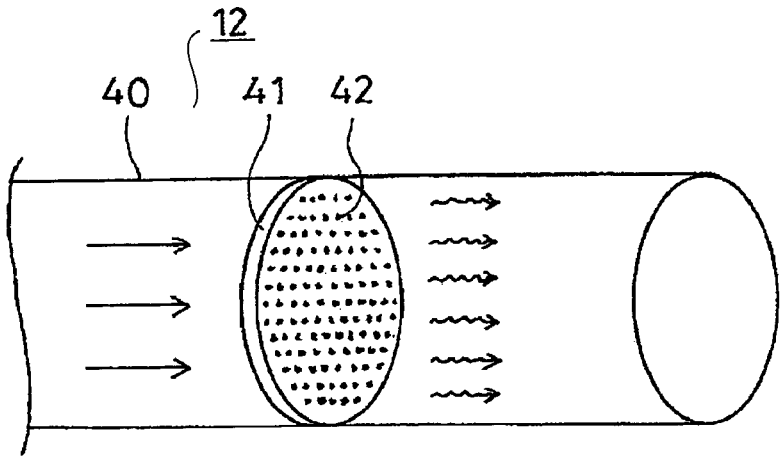
FIG. 5 is an explanatory view showing one example of a constitution of fine processing means in FIG. 4.
Figure 6:
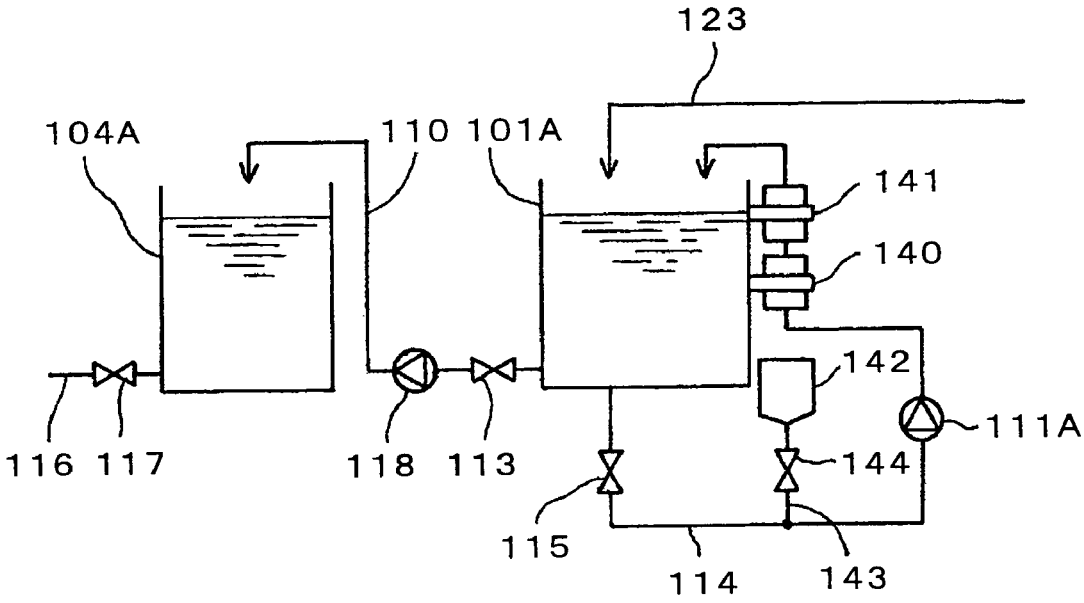
F I G. 6 Prior Art
FIG. 6 is an explanatory view of a manufacturing apparatus of reformed water of a prior art.

FIG. 1 shows a first embodiment, and shows an initial manufacturing process of a batch type process of manufacturing a water emulsion fuel from a state in which substantially no water emulsion fuel exists in a mixing tank 2 in the manufacturing method of the water emulsion fuel. Since a manufacturing apparatus is the same as in FIG. 4, the explanation thereof will be omitted, and the manufacturing method of the water emulsion fuel will be explained following the process steps based on FIG. 1 and FIG. 4.

(a) In a fuel and additive charging step from a point A, a controller 35 outputs a control signal to close a solution delivery circuit on-off valve 13 and opens a circulation circuit on-off valve 15. Next, the controller 35 outputs a control signal to the fuel circuit on-off valve 22 to open it, supplies a petroleum fuel to the mixing tank 2 from a fuel supply circuit 21 until a fuel level switch 32 is turned ON, and closes the fuel circuit on-off valve 22. At the same time, the controller 35 outputs a control signal to an additive metering pump 26 to add a predetermined amount of additive into the mixing tank 2 from an additive supply circuit 25.

(b) In an agitating step between A and B, the controller 35 outputs a control signal simultaneously with the start of the fuel supply to operate an agitating device 3, and agitates the fuel and the additive for a predetermined period of time. Due to this, the additive is favorably dispersed into the fuel.

(c) After an agitating step, in a water charging step from the point B, the controller 35 outputs a control signal to a water circuit on-off valve 24 to open it, supplies water to the mixing tank 2 from a water supply circuit 23 until a water level switch 31 is turned ON, and closes the water circuit on-off valve 24.

(d) In a fine processing step between B and C, the controller 35 outputs a control signal simultaneously with the start of the water charging step to drive a mixture solution pump 11. The mixture solution passes through fine processing means 12 and returns to the mixing tank 2 via the circulation circuit on-off valve 15 and a circulation circuit 14. In this situation, the mixture solution of the fuel and the additive is pumped out first and delivered to the fine processing means 12, and therefore the fuel and the additive are finely processed and mixed more favorably. Thereafter, water is delivered to the fine processing means 12 and finely processed. Due to this, the fuel and water are in the state in which they are easily emulsified, but since the fuel precedes, the finely processed cluster is in the oil rich state, and thus an O/W type water emulsion fuel is not obtained.

(e) After the fine processing step is finished, in a separating step between C and D, the controller 35 outputs a control signal to stop a fragmentation step for a predetermined period of time, and separates the water and the fuel in the mixing tank 2. As a result, water with large specific gravity is precipitated at the lower part of the mixing tank 2.

(f) After the separating step is finished, in an emulsifying step between D and E, the controller 35 outputs a control signal to drive the mixture solution pump 11. The mixture solution passes through the fine processing means 12 and returns to the mixing tank 2. Since the water precedes at this time, the finely processed cluster is in the water rich state, and water clusters are bonded around the fuel clusters containing the additive to be emulsified, thus obtaining the O/W type water emulsion fuel.

The manufactured water emulsion fuel is properly delivered to the oil storage tank 4, but this is the same as in the method of the above-described Japanese Patent Application No. 2001-094264 (Japanese Patent Laid-open No. 2002-294260), and the detailed explanation thereof will be omitted.

The method of the above-described first embodiment is confirmed with the experiment by the present inventor.

Namely, in the batch type manufacturing method of the water emulsion fuel, the O/W type water emulsion fuel of good quality can be reliably obtained in the initial manufacturing process of manufacturing the water emulsion fuel from the state in which substantially no water emulsion fuel exists in the mixing tank.

Figure 2:
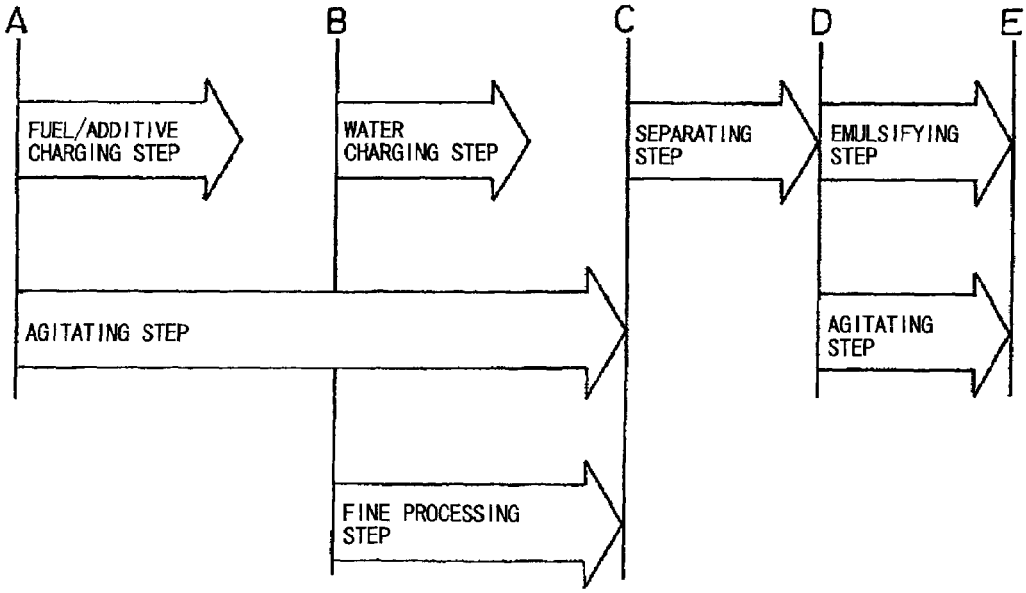
FIG. 2 is a flow chart of manufacture of a water emulsion fuel according to a second embodiment of the present invention.

FIG. 2 is a flow chart of manufacture of a second embodiment. The explanation of the same parts as in the first embodiment will be omitted, and only a different part will be explained. Between B and C, an agitating step is provided in parallel with the fine processing step, and the controller 35 outputs a control signal to drive an agitating device 3. Between D and E, the agitating step is provided in parallel with the emulsifying step, and the controller 35 outputs the control signal to drive the agitating device 3. As a result, the fuel, the additive and water are mixed further uniformly, and emulsification of the fuel and water is further promoted. The agitating step may be provided either between B and C, or between D and E.

Figure 3:
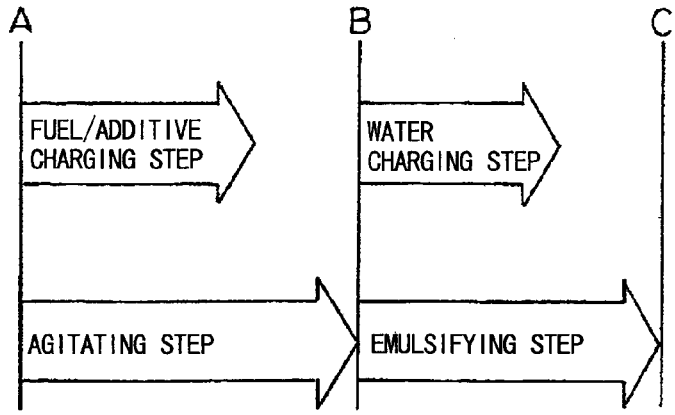
FIG. 3 is a flow chart of manufacture of a water emulsion fuel according to a third embodiment of the present invention.

FIG. 3 relates to a third embodiment, and shows a manufacturing step of the batch type process from the second time on. This manufacturing process is for manufacturing the water emulsion fuel from the state in which a predetermined amount of water emulsion fuel exists in the mixing tank 2, namely, from the state in which the water emulsion fuel remains up to the position of the low-level liquid level switch 33 of the mixing tank 2 after the water emulsion fuel is pumped out into the oil storage tank 4 from the mixing tank 2. Hereinafter, the explanation will be made based on FIG. 3 and FIG. 4.

(a) In the fuel and additive charging step at the point A, the controller 35 outputs the control signal to close the solution delivery circuit on-off valve 13 and opens the circulation circuit on-off valve 15. Next, the controller 35 outputs the control signal to the fuel circuit on-off valve 22 to open it, and supplies the petroleum fuel onto the water emulsion fuel remaining in the mixing tank 2 from the fuel supply circuit 21 until the fuel level switch 32 is turned ON, and closes the fuel circuit on-off valve 22. At the same time, the controller 35 outputs the control signal to the additive metering pump 26 to add a predetermined amount of additive into the mixing tank 2 from the additive supply circuit 25.

(b) In the agitating step between A and B, the controller 35 outputs the control signal to operate the agitating device 3 simultaneously with the start of the fuel supply, agitates the water emulsion fuel, the fuel, and the additive for a predetermined period of time. Due to this, the additive is favorably dispersed into the fuel.

(c) After the agitating step is finished, in the water charging step at the point B, the controller 35 outputs the control signal to the water circuit on-off valve 24 to open it, supplies the water to the mixing tank 2 from the water supply circuit 23 until the water level switch 31 is turned ON, and closes the water circuit on-off valve 24.

(d) In the emulsifying step between B and C, the controller 35 outputs the control signal to drive the mixture solution pump 11 simultaneously with the start of the water charging step. The charged solution passes through the fine processing means 12 to return to the mixing tank 2. Since the water emulsion fuel remaining at the bottom part of the mixing tank 2 precedes at this time, the water rich state is established, and the water and the fuel are emulsified, thus obtaining the O/W type water emulsion fuel.

As in the above-described third embodiment, the manufacturing process from the second time on has smaller number of steps, and the O/W type water emulsion fuel can be manufactured efficiently in a short time. The agitating step may be provided in parallel with the emulsifying step of this process.

What is claimed is:

1. A method of manufacturing an emulsion of water and fuel using a series of batch processing steps comprising:

(a) charging a fuel and an additive into a mixing tank;

(b) agitating the fuel and the additive charged into the mixing tank;

(c) charging water into the mixing tank and forming a mixture solution of the fuel, additive and water, while agitating the mixture solution;

(d) reducing cluster sizes of the fuel and water in the mixture solution by pumping the mixture solution through a processing means and returning the mixture solution into the mixing tank;

(e) separating the mixture solution in the mixing tank and forming a water rich portion of the mixture solution at a bottom portion of the mixing tank; and (f) emulsifying the mixture solution from the bottom portion of the mixing tank at first through the processing means and returning the mixture solution to the mixing tank, thereby forming the emulsion of water and fuel, wherein the processing means includes at least one plate having holes therein, and in steps (d) and (f) the mixture solution passes through the holes in the at least one plate.

2. The method of manufacturing the emulsion of water and fuel according to claim 1, wherein the hales have a diameter of about 0.5 mm to 1 mm.

3. A method of manufacturing an emulsion of water and fuel using a series of batch processing steps comprising:

(a) charging a fuel and an additive into a mixing tank containing the emulsion of water and fuel having a first volume;

(b) agitating the emulsion of water and fuel having a first volume together with the fuel and additive and fonning a first mixture solution;

(c) charging water into the mixing tank and forming a second mixture solution; and (d) emulsifying the second mixture solution by pumping the second mixture solution from the mixing tunic through a processing means, which reduces clusters of liquid molecules in the mixture solution into smaller clusters, and returning the resulting emulsion of water and fuel having a second volume larger than the first volume to the mixing tank, wherein the processing means includes at least one plate having holes therein, and in step (d) the mixture solution passes through the holes in the at least one plate.

4. The method of manufacturing the emulsion of water and fuel according to claim 3, wherein the holes have a diameter of about 0.5 mm to 1 mm.

5. A method of manufacturing an emulsion of water and fuel using a series of batch processing steps comprising:

(a) charging a fuel and an additive into a mixing tank;

(b) agitating the fuel and the additive charged into the mixing tank and forming a mixed solution of the fuel and additive;

(c) charging and mixing water into the mixing tank and fanning a first mixture solution of the fuel, additive and water;

(d) reducing clusters of liquid molecules in the first mixture solution into smaller clusters by pumping the first mixture solution through a processing means and returning to the mixing tank, thereby fanning a second mixture solution of the fuel, additive and water;

(e) separating the second mixture solution in the mixing tank and fanning a water rich portion in the second mixture solution at a bottom portion of mixing tank; and (f) emulsifying the separated second mixture solution from the bottom portion of the mixing tank at first through the processing means, thereby fanning the emulsion of water and fuel, wherein the processing means includes at least one plate having hales therein, in step (d) the first mixture solution passes through the holes in the at least one plate, and in step (f) the second mixture solution passes through the holes in the at least one plate.

6. The method of manufacturing the emulsion of water and fuel according to claim 5, wherein the holes have a diameter of about 0.5 mm to 1 mm.

* * * * *

UNITED STATES PATENT AND TRADEMARK OFFICE

CERTIFICATE OF CORRECTION

PATENT NO. : 7,559,960 B2
APPLICATION NO. : 10/615801
DATED : July 14, 2009
INVENTOR(S) : Sato It is certified that error appears in the above-identified patent and that said Letters Patent is hereby corrected as shown below:

IN THE CLAIMS:

Col. 8, claim 2, line 28, change "hales" to --holes--
claim 3, line 36, change "fonning" to --forming--
claim 3, line 41, change "tunic" to --tank--
claim 5, line 61, change "fanning" to --forming-- and
claim 5, line 66, change "fanning" to --forming--.

Col. 9, claim 5, line 2, change "fanning" to --forming--
claim 5, line 3, change "mixing tank" to --the mixing tank--
claim 5, line 6, change "fanning" to --forming-- and
claim 5, line 9, change "hales" to --holes--.

Signed and Sealed this

Twentieth Day of July, 2010

David J. Kappos

David J. Kappos
*Director of the United States Patent and Trademark Office*